US006052078A

United States Patent [19]

Waterman

[11] Patent Number: 6,052,078

[45] Date of Patent: Apr. 18, 2000

[54] APPARATUS FOR OVERCOMING THE BLOCKAGE EFFECT OF AN OBJECT IN THE PATH OF A RADIATING BEAM OF RF ENERGY

[75] Inventor: Timothy G. Waterman, Eldersburg, Md.

[73] Assignee: Northrop Grumman Corporation, Los Angeles, Calif.

[21] Appl. No.: 09/191,568

[22] Filed: Nov. 12, 1998

[51] Int. Cl.[7] ..... H01Q 1/28

[52] U.S. Cl. ..... 342/5; 342/159; 343/705; 343/708; 343/718

[58] Field of Search ..... 342/5, 6, 7, 8, 342/9, 10, 11, 12, 13, 14, 16, 1, 2, 159, 175, 350; 343/705, 706, 707, 708, 709, 710, 711, 712, 713, 714, 715, 716, 717, 718

[56] References Cited

U.S. PATENT DOCUMENTS

| | | | |
|---|---|---|---|
| 2,801,411 | 7/1957 | Weinstock | 342/5 |
| 4,019,699 | 4/1977 | Wintersdorff et al. | 342/5 X |
| 4,369,448 | 1/1983 | Satoh et al. | 342/5 X |
| 4,403,222 | 9/1983 | Bitter, Jr. et al. | 342/5 X |
| 4,924,228 | 5/1990 | Novak et al. | 342/2 |
| 5,128,678 | 7/1992 | Novak et al. | 342/2 |
| 5,250,950 | 10/1993 | Scherrer et al. | 342/2 |
| 5,276,447 | 1/1994 | Shingo | 342/2 |

*Primary Examiner*—Bernarr E. Gregory

[57] ABSTRACT

Apparatus which overcomes the blockage effect of an object in the path of a beam of RF energy, includes a conformal array of parasitic electrical conductor elements having a length of about λ/3 and which are selectively located above the surface of the object, also at a height of about λ/3. The parasitic conductor elements operate to duct the RF energy of the beam around the object with minimal loss in gain and effect on the beam's radiation pattern.

20 Claims, 5 Drawing Sheets

APPARATUS FOR OVERCOMING THE BLOCKAGE EFFECT OF AN OBJECT IN THE PATH OF A RADIATING BEAM OF RF ENERGY

BACKGROUND OF THE INVENTION

This invention relates generally to the elimination of blockage and/or distortion of radiating RF energy by an object and more particularly to a relatively simple method and apparatus which permits RF energy transmitted from a radar or communication equipment to wrap around the blockage with minimal loss in gain and relatively little destruction to the radiation pattern.

For many radar and communication applications there are often undesirable large and small metallic structures nearby which depending upon the size and location of the object and the polarization of the antenna can cause severe blockage of the RF energy radiated therefrom. Nevertheless, they are there for necessary reasons such as the tail and wings of an aircraft or the mast(s) of a ship or even the feed horn of a reflector type antenna system. In such instances a deleterious effect on antenna performance often occurs, particularly when a beam of RF energy is pointed at the object. In the past, RF energy absorbent materials have been applied to mitigate degradation of the sidelobes. However, it does little or nothing to fill in the "hole" that is caused by the blockage of the RF signal when it hits or bounces off the surface of the object.

SUMMARY

Accordingly, it is an object of the invention to overcome the effect of RF blockage by an object in the path of radiated RF energy.

It is a further object of the invention to overcome the problem of the blockage of the RF signal in a radar beam by directing or ducting the RF energy around the object.

It is another object of the invention to overcome the problem of the blockage of RF energy by an object by permitting the RF energy to wrap around the blocking object and continue propagating on the other side thereof.

The foregoing and other objects of the invention are achieved by apparatus comprising a plurality of parasitic electrical conductor elements selectively located above the surface of an object in the path of a beam of RF energy, wherein the parasitic conductor elements have electrical characteristics which operate to duct the RF energy of the beam around the object and which continues propagating on the other side of the object with minimal loss in gain and effect on the main lobe as well as the sidelobes of the RF radiation pattern of the beam. The parasitic conductor elements are conformally located above the surface of the object in the path of the beam and have an electrically short length and height above the surface, e.g., above ⅓ wavelength of the RF energy of the beam.

Further scope of the applicability of the present invention will become apparent from the detailed description given hereinafter. It should be understood, however, that the detailed description and specific example, while indicating the preferred embodiment of the invention, is provided by way of illustration and since various changes and modifications, within the spirit and scope of the invention, will become apparent to those skilled in the art from this detailed description is not meant to be so limited.

BRIEF DESCRIPTION OF THE DRAWINGS

The present invention will become more fully understood from the detailed description given hereinafter and the accompanying drawings which are provided by way of illustration and are thus not meant to be limitative of the invention, and wherein.

DETAILED DESCRIPTION OF THE INVENTION

Figure 1:
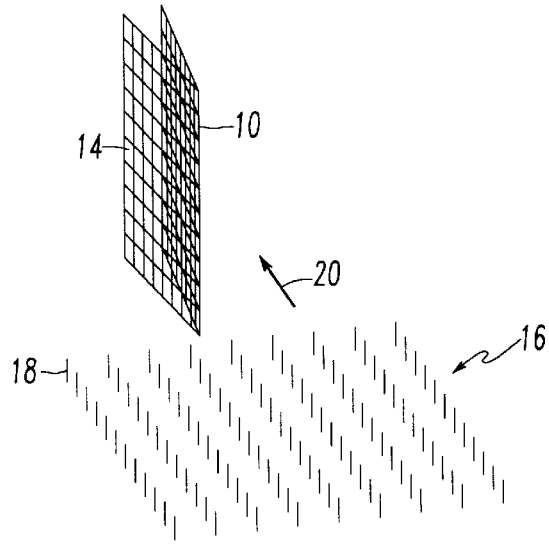
FIG. 1 is a computer model representation of a wedge shaped object located in the path of a RF beam of energy radiated from an adjacent array of antenna elements.
Figure 2:
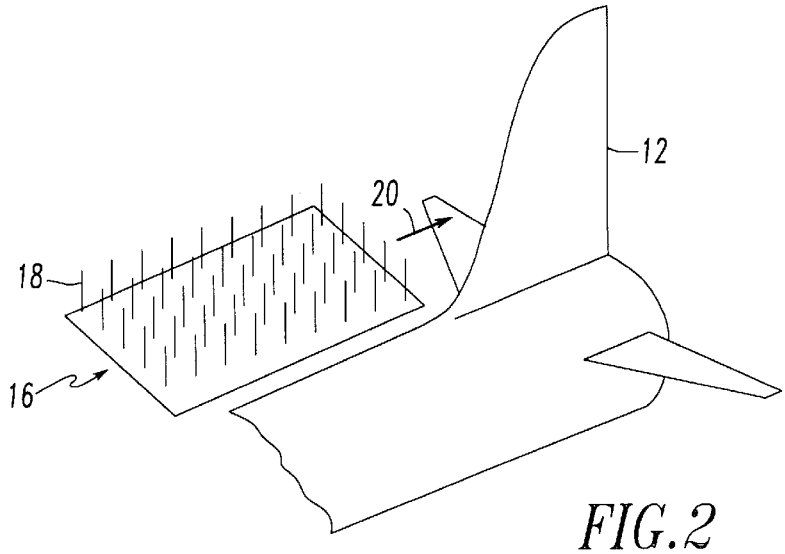
FIG. 2 is a diagram illustrative of an antenna array located in front of the tail of an aircraft.
Figure 3:
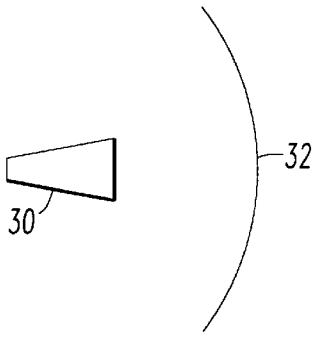
FIG. 3 is a diagram illustrative of an RF feed horn located in front of a parabolic reflector of a reflector type of antenna system.
Figure 9:
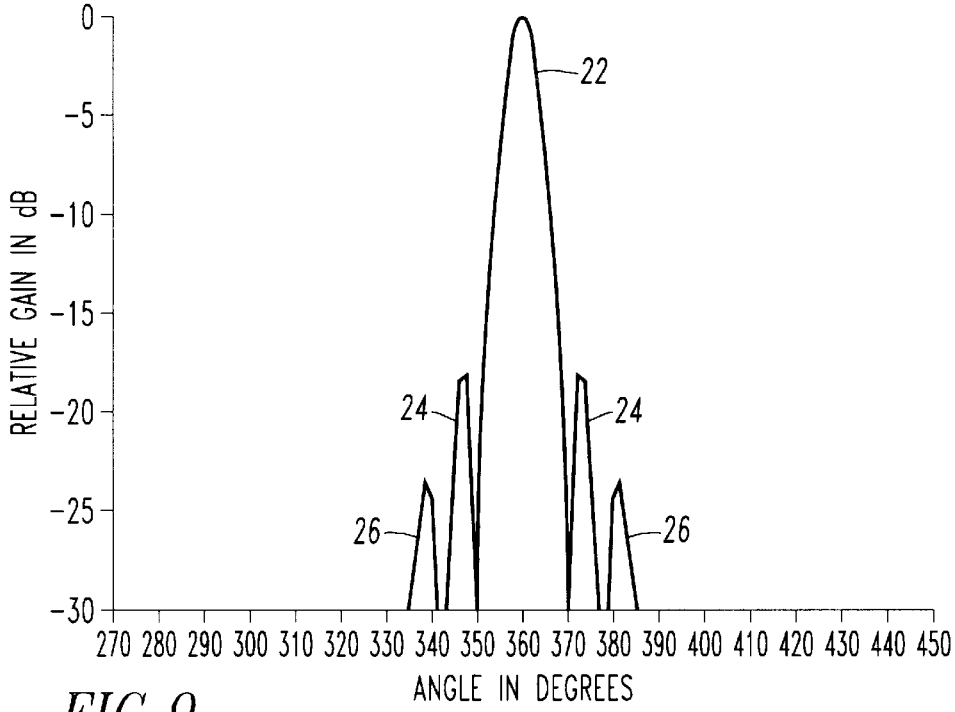
FIG. 9 is illustrative of a reference antenna pattern generated, for example, by the array shown in FIG. 1 wherein there is no blockage of the RF energy radiated therefrom.

Referring now to the drawing figures and more particularly to FIGS. 1–3, FIG. 1 is illustrative of a wedge shaped object 10 modeled by a digital computer to represent a wedge shaped tail 12 of an aircraft as shown in FIG. 2. The object 10 in FIG. 1 is shown comprised of a matrix of crossed wires 14. In front of the wedge shaped object 10 is located a rectangular array 16 of radiating elements 18 which operate to generate a beam 20 of RF energy which in absence of the object 10 would generate a pattern as shown in FIG. 9 consisting of a well defined main lobe 22 and one or more sidelobes 24 and 26.

Figure 10:
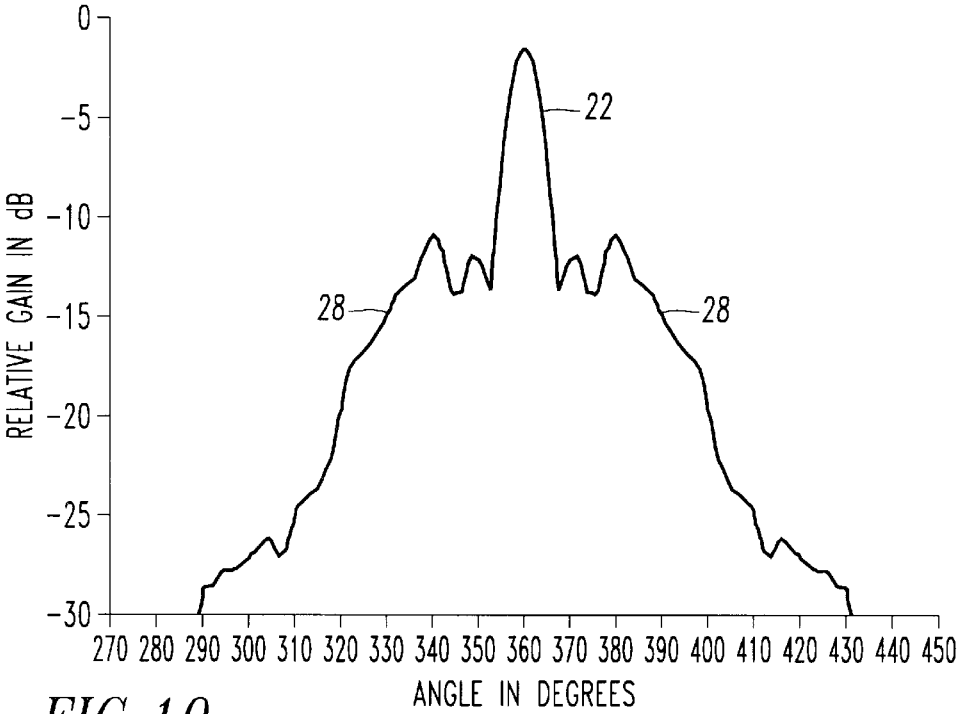
FIG. 10 is illustrative of an antenna pattern where the RF energy is blocked by a wedge shaped object such as shown in FIG. 1.

When an object, such as that shown by reference numeral 10 in FIG. 1, is located adjacent the array 16 the gain of the main lobe 22 is reduced such as shown in FIG. 10, and the sidelobe energy increased and spread as shown by reference numeral 28 in FIG. 10. Such a result occurs not only in an environment where the array 16 is positioned forward of the tail structure of an aircraft as shown in FIG. 2, but can occur by a feed horn 30 positioned in front of a parabolic reflector 32 of a reflector type of RF antenna system as shown in FIG. 3.

The blockage problem arises due to the fact that in most instances, the polarization of the RF energy in the beam 20 is vertical so that the worst RF blockage condition exists when an intersecting edge of the object is aligned with the direction of the polarization.

Figure 4:
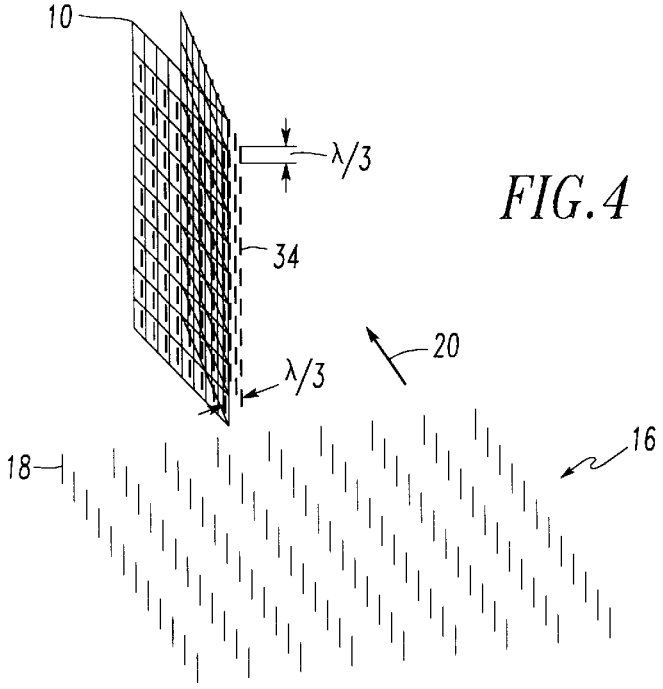
FIG. 4 is a diagram illustrative of a computer model of a wedge shaped object including an array of parasitic conductor elements located above the surface of the object in accordance with a first embodiment of the invention.

This now leads to a relatively simple solution to the blockage problem by including a structure which propagates or ducts the RF energy in the beam 20 around the object 10 which, as shown in FIGS. 2 and 3, may be the metal conducting surface 13 of the tail 12 of an aircraft or the metallic outside surface 31 of the feed horn 30 of a reflective type antenna system. The solution comprises locating a conformal array of floating parasitic electrical conductor elements above the obstructing conductive outer surface of the object, as shown in FIGS. 4–8. The parasitic conductor elements shown, for example, in FIG. 4 by reference numeral 34 comprise passive segments of electrical material which are electrically short having a physical length which is small in relation to the wavelength of the RF energy in the beam 20 and preferably comprise elements which are about ⅓ the wavelength (λ) of the RF energy and are located above the surface of the object 10 also by a distance ⅓ λ as shown in FIG. 4. The parasitic conductor elements 34 substantially cover the blocking surface area of the object and have a predetermined material spacing which depends on the bandwidth, and to some extent, on the size of the object being covered.

Figure 5:
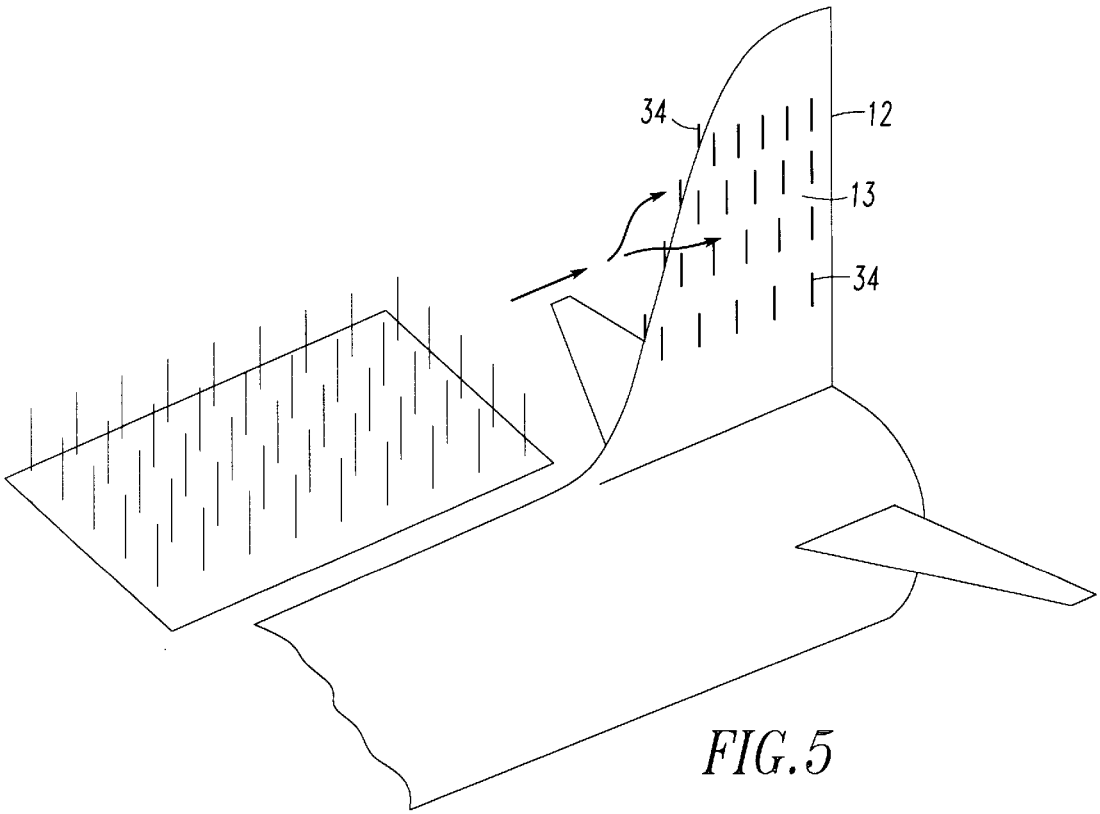
FIG. 5 is a diagram illustrative of an embodiment of the invention located on the tail portion of an aircraft.
Figure 6:
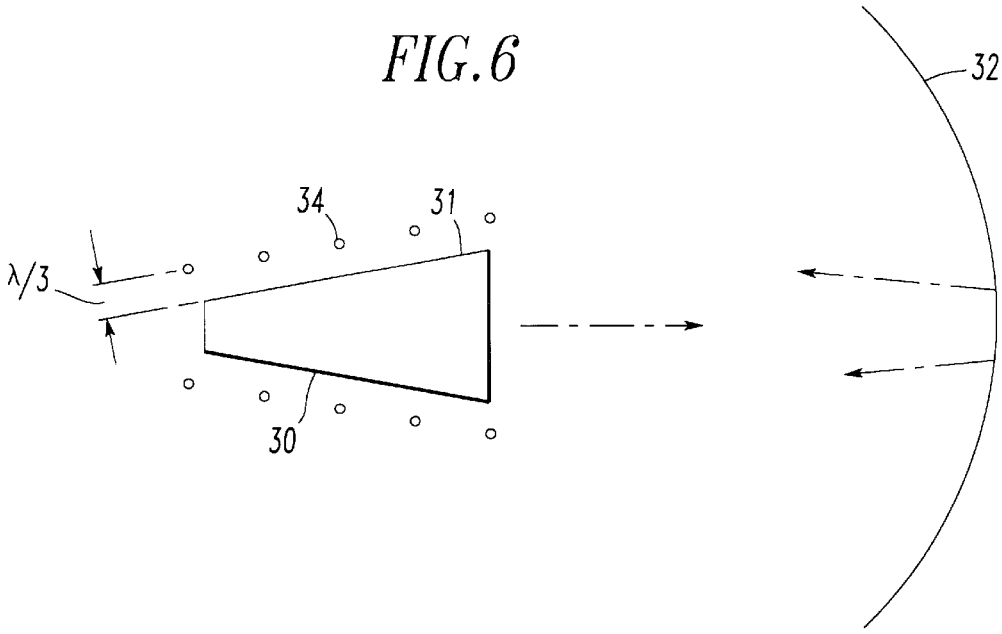
FIG. 6 is a diagram illustrative of an embodiment of the invention associated with a reflector type of antenna system.
Figure 11:
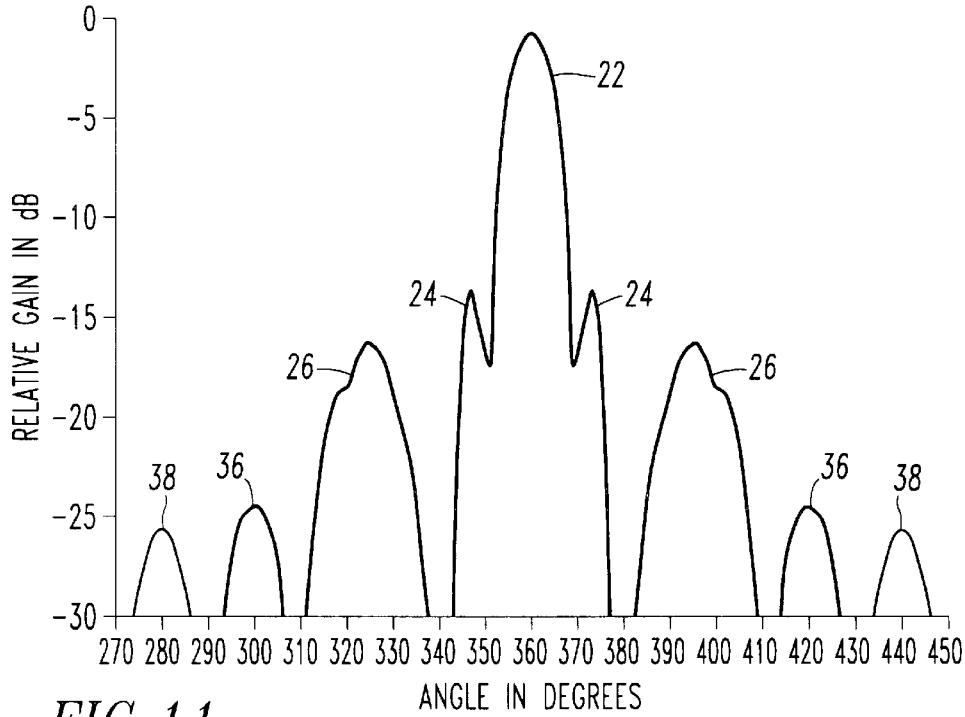
FIG. 11 is illustrative of an antenna pattern where an array of parasitic elements is located above the surface of the object as shown in FIG. 4.

In any event, the conductor elements 34 are intended to straddle the conducting surface of the obstructing object in such a manner that a conformal array is implemented. Such a configuration, for example, as shown in FIG. 5 allows the RF energy to propagate around the conducting surface 13 of the tail 12 with minimal loss in gain and destruction of the principal lobe 22 and sidelobes 24, 26, 36, and 38, as shown, for example, in the radiation pattern depicted in FIG. 11, wherein substantially all of the main lobe 22 is transmitted past the obstruction. As can be seen with reference to FIGS. 9, 10 and 11 in FIG. 10 which is illustrative of a blocking condition, 40% of the main beam energy is being lost and the sidelobes are relatively high at around −10 dB whereas with the parasitic array structure all but about 7% is transmitted in the main beam past the tail as shown in FIG. 11 with the sidelobes also dropping about 5 dB.

It is to be noted that since the structure is located adjacent to the conducting surface, its ability to duct the wave is independent of how far the radiating element(s) 18 is to the blocking object and, accordingly, operates not only for close radiators but for far radiators as well.

Figure 7:
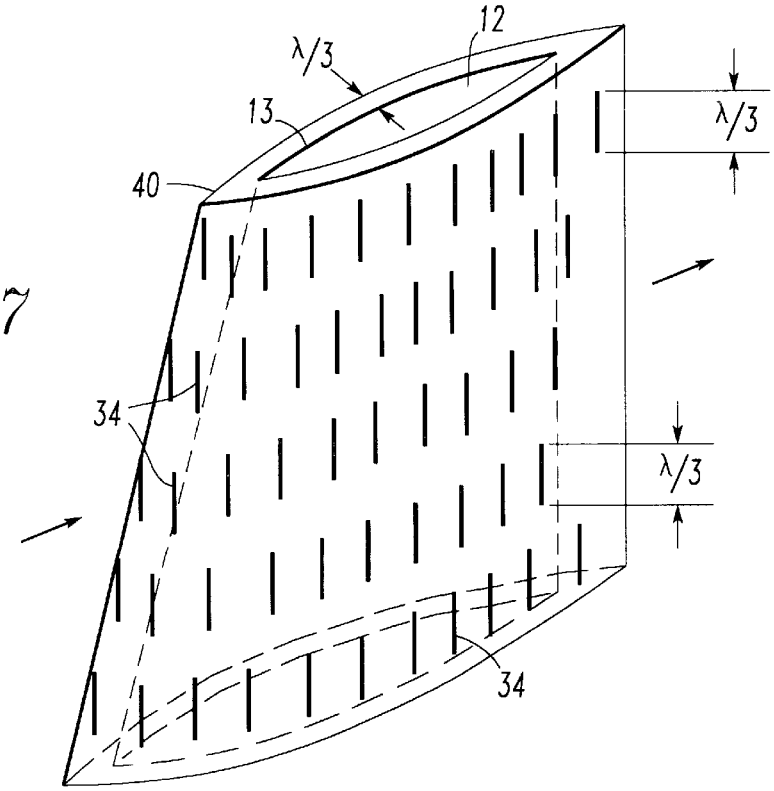
FIG. 7 is a prospective view illustrative of a conformal array of parasitic electrical conductor elements located on a covering of dielectric spacer material fitted for over the tail surface of an aircraft.
Figure 8:
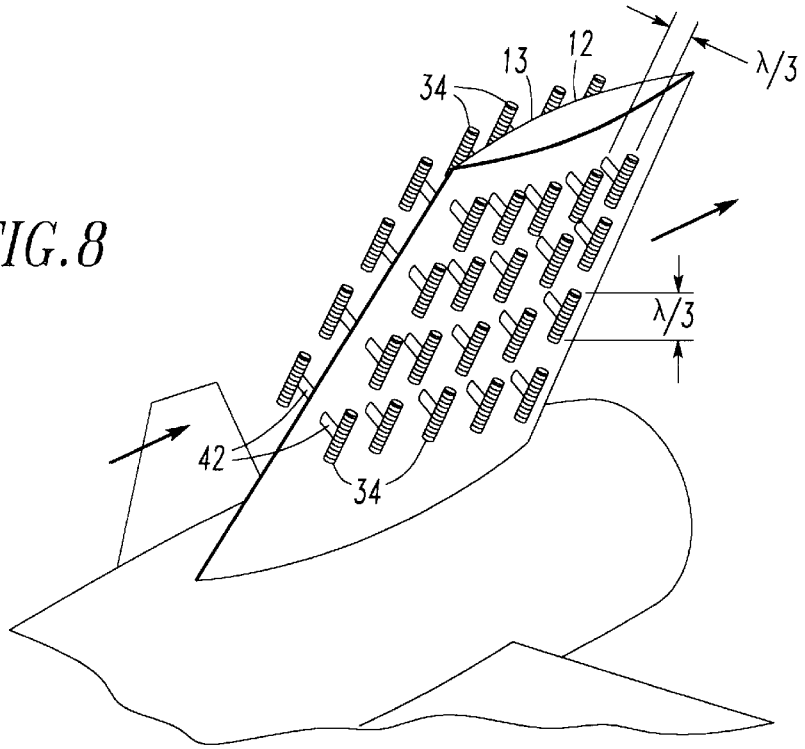
FIG. 8 is a prospective view illustrative of an array of parasitic electrical conductor elements secured to the tail surface of an aircraft by individual standoff elements.

Referring now to the embodiments shown in FIGS. 7 and 8, they are intended to be illustrative of two different configurations by which the parasitic electrical conductor elements 34 are supported in position away from the conductive surface of the obstruction which is shown comprising the tail portion 12 of an aircraft. As shown in FIG. 7, a dielectric foam spacer member 40 is formed around the tail 12 and so as to support an array of passive parasitic conductor elements 34 about λ/3 in length, a distance of about λ/3 above the conductive surface 13 of the tail 12.

In the configuration shown in FIG. 8, a conformal array of parasitic conductor elements 34 are mounted above the tail surface 13 by means of respective stand-off elements 42 having a length of about λ/3 so as to again implement elements which are λ/3 long and λ/3 above the conducting surface 13. The stand-off elements 42 preferably comprise non-conducting posts. However, it should be noted that the parasitic elements may when desirable be comprised of floating dipole antenna elements whereupon one half of the dipole assembly would be connected to the surface 13 via a conductive member having a length of about λ/3.

Accordingly, what has been shown and described is a relatively simple structure which when applied to a surface obstructing the passage of RF energy permits the energy to flow i.e., propagate around the blockage with minimal loss in gain and relatively little attenuation to the sidelobes. Moreover, this structure can easily be incorporate into a radar and communications application if designed at an early stage of its construction.

Having thus shown and described what are presently considered to be the preferred embodiments of the subject invention it should be known that the same has been made by way of illustration and not limitation. Accordingly, all modifications, alterations, and changes, coming within the spirit and scope of the invention as set forth in the following claims are herein meant to be included.

What is claimed is:

1. Apparatus for overcoming a blockage effect caused by an object in the path of a beam of RF energy, comprising:

a plurality of parasitic electrical conductor elements of predetermined electrical length selectively located a predetermined distance above the surface of the object, said parasitic conductor elements operating to duct the RF energy of the beam around the object with minimal loss in gain and effect on the main lobe and sidelobes of the RF pattern of the beam.

2. The apparatus of claim 1, wherein said plurality of parasitic electrical conductor elements comprises a passive array of said conductor elements.

3. The apparatus of claim 1, wherein said plurality of parasitic electrical conductor elements comprises electrical conductors having a physical length which is less than a wavelength of said RF energy.

4. The apparatus of claim 1, wherein said parasitic electrical conductor elements comprise conductor elements having a length of about ⅓ λ, where λ is the wavelength of the RF energy.

5. The apparatus of claim 4, wherein said conductor elements are mounted about ⅓ λ above the surface of the object, where λ is the wavelength of the RF energy.

6. The apparatus of claim 5, wherein said parasitic conductor elements are located on electrical insulator means secured to the surface of the object.

7. The apparatus of claim 6, wherein said electrical insulator means comprises dielectric spacer means.

8. The apparatus of claim 7, wherein said dielectric spacer means comprises dielectric material of predetermined thickness located on the outer surface of said object.

9. The apparatus of claim 5, wherein said parasitic antenna elements are located above the surface of the object by means of respective stand-off elements.

10. The apparatus of claim 5, wherein said electrical conductor elements comprises an array of dipole elements.

11. The apparatus of claim 1, wherein the object comprises a portion of an aircraft.

12. The apparatus of claim 1, wherein the object comprises a wing or tail portion of an aircraft.

13. The apparatus of claim 1, wherein the object comprises means for feeding a reflector type antenna system.

14. The apparatus of claim 1, wherein the object comprises a feed horn of a reflector type antenna system.

15. A method for overcoming a blockage effect of a conducting surface on an object in the path of a beam of RF energy comprising:

locating a plurality of parasitic electrical conductor elements above the surface of the object, said conductor elements operating to duct RF energy passed the surface of the object with minimum adverse effects, and directing the beam of RF energy toward the object, whereby the RF energy of the beam is ducted around the object with minimal loss in gain and effect on the main lobe and principal sidelobes of the RF pattern of the beam.

16. The method of claim 15, wherein said parasitic conductor elements comprise an array of passive conductor elements having a physical length of less than a wavelength of the RF energy in said beam of RF energy.

17. The method of claim 16, wherein said step of locating includes conformally locating said array of parasitic conductor elements above a conductive surface of the object.

18. The method of claim 17, and additionally including the step of locating said array of parasitic conductor elements above the conducting surface a distance equal to a fraction of the wavelength of said RF energy.

19. The method of claim 18, and additionally including the step of forming the parasitic conductor elements so as to have a length which is equal to a fraction of the wavelength of said RF energy.

20. The method of claim 19, wherein said parasitic conductor elements have a length of about ⅓ $\lambda$ and are located about ⅓ $\lambda$ above the conductive surface, where $\lambda$ is the wavelength of the RF energy.

* * * * *